US008214922B2

(12) United States Patent
Moore et al.

(10) Patent No.: US 8,214,922 B2
(45) **Date of Patent: *Jul. 10, 2012**

(54) WATER SHORTS INCORPORATING A STRETCH TEXTILE

(75) Inventors: Bruce Yin Moore, Laguna Beach, CA (US); Ryan Michael Hurley, Costa Mesa, CA (US)

(73) Assignee: Hurley International, LLC., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/901,111

(22) Filed: Oct. 8, 2010

(65) Prior Publication Data

US 2011/0107495 A1 May 12, 2011

Related U.S. Application Data

(63) Continuation of application No. 11/837,216, filed on Aug. 10, 2007, now Pat. No. 7,849,518.

(51) Int. Cl.
*A41D 7/00* (2006.01)

(52) U.S. Cl. ..... 2/67; 2/236; 2/238; 2/220

(58) Field of Classification Search ..... 2/67, 79, 2/82, 220, 227, 236, 238; 28/155
See application file for complete search history.

(56) References Cited

U.S. PATENT DOCUMENTS

| | | | | |
|---|---|---|---|---|
| 1,797,115 | A | | 3/1931 | Atkinson |
| 1,831,451 | A | | 11/1931 | Jackson |
| 2,854,669 | A | | 10/1958 | Cohen |
| 3,169,558 | A | | 2/1965 | Aleixo |
| 3,357,076 | A | | 12/1967 | Greenwald |
| 3,842,437 | A | | 10/1974 | Campbell et al. |
| 4,345,908 | A | | 8/1982 | Mohr, Jr. et al. |
| 4,397,636 | A | | 8/1983 | Ganshaw |
| 4,523,337 | A | | 6/1985 | Leibowitz |
| 5,161,257 | A | | 11/1992 | Arensdorf |
| 5,390,376 | A | | 2/1995 | Marx et al. |
| 5,487,710 | A | * | 1/1996 | Lavorgna et al. ..... 482/55 |
| 5,645,924 | A | | 7/1997 | Hamilton |
| 5,768,703 | A | | 6/1998 | Machado et al. |

(Continued)

FOREIGN PATENT DOCUMENTS

EP 1352576 10/2003

(Continued)

OTHER PUBLICATIONS

Letter from Seyamack Kouretchian of Coast Law Group, dated Jul. 16, 2009, regarding Hurley's U.S. Patent Application 2009/0038046-A1.

(Continued)

*Primary Examiner* — Shelley Self
*Assistant Examiner* — Alissa Tompkins
(74) *Attorney, Agent, or Firm* — Plumsea Law Group, LLC

(57) ABSTRACT

An article of apparel, which may be a pair of water shorts, includes a first textile and a second textile. The first textile forms a majority of an exterior surface and an opposite interior surface of the apparel, and the first textile exhibits at least thirty percent stretch prior to tensile failure. The second textile is located around a waistband portion of the apparel, and the second textile exhibits less than ten percent stretch prior to tensile failure.

24 Claims, 8 Drawing Sheets

U.S. PATENT DOCUMENTS

| | | | | |
|---|---|---|---|---|
| 5,987,721 | A | 11/1999 | Morris | |
| 6,199,215 | B1 | 3/2001 | Biggerstaff | |
| 6,243,879 | B1 | 6/2001 | Lyden | |
| 6,401,250 | B1 | 6/2002 | McNabb | |
| 6,647,550 | B1 | 11/2003 | Matsuzaki et al. | |
| 6,817,031 | B1 * | 11/2004 | Gravlin | 2/67 |
| 7,849,518 | B2 * | 12/2010 | Moore et al. | 2/67 |
| 7,941,871 | B1 | 5/2011 | Jorgensen | |
| 2003/0208829 | A1 | 11/2003 | Ragot et al. | |
| 2004/0098784 | A1 * | 5/2004 | Desai | 2/69 |
| 2005/0165200 | A1 | 7/2005 | Selle et al. | |
| 2005/0223753 | A1 | 10/2005 | Nordstrom | |
| 2006/0270294 | A1 | 11/2006 | Hamano et al. | |
| 2007/0101481 | A1 | 5/2007 | Stokesbary | |
| 2008/0256675 | A1 * | 10/2008 | Di Lorenzo | 2/67 |

FOREIGN PATENT DOCUMENTS

| | | |
|---|---|---|
| EP | 1627574 | 2/2006 |
| FR | 2742171 | 6/1997 |
| GB | 766834 | 1/1957 |
| GB | 1111116 | 4/1968 |
| JP | 48-3618 | 5/1946 |
| JP | 7-9925 | 2/1995 |
| JP | 2005-299070 | 10/2005 |
| JP | 2005299070 | 10/2005 |
| WO | WO2004/009705 | 1/2004 |
| WO | WO2004009705 | 1/2004 |

OTHER PUBLICATIONS

Attachment to Letter from Seyamack Kouretchian of Coast Law Group, dated Jul. 16, 2009, including excerpts from O'Neill american dna spring_03 men's clothing & accessories marketing materials.
Letter from Duane M. Byers of Nixon & Vanderhye P.C., dated Jul. 24, 2009, regarding U.S. Patent Application of Moore and Hurley, U.S. Appl. No. 11/837,216, filed Aug. 10, 2007.
Exhibit A accompanying Letter from Duane M. Byers of Nixon & Vanderhye P.C., dated Jul. 24, 2009, including US Patent Application Publication 2003/020889 A1.
Exhibit B accompanying Letter from Duane M. Byers of Nixon & Vanderhye P.C., dated Jul. 24, 2009, including excerpts from Billabong mens sportswear spring 2000 marketing materials.
Exhibit C accompanying Letter from Duane M. Byers of Nixon & Vanderhye P.C., dated Jul. 24, 2009, including excerpts from Billabong mens sportswear spring 2000 marketing materials.
Exhibit D accompanying Letter from Duane M. Byers of Nixon & Vanderhye P.C., dated Jul. 24, 2009, including excerpts from Billabong hi summer 2007 mens garments marketing materials.
Exhibit E accompanying Letter from Duane M. Byers of Nixon & Vanderhye P.C., dated Jul. 24, 2009, including excerpts from Billabong hi summer 2007 mens garments marketing materials.
Exhibit F accompanying Letter from Duane M. Byers of Nixon & Vanderhye P.C., dated Jul. 24, 2009, including Xcel Wetsuits marketing materials.
Exhibit G accompanying Letter from Duane M. Byers of Nixon & Vanderhye P.C., dated Jul. 24, 2009, including excerpts from Surfer Magazine, Jun. 2006.
Exhibit H accompanying Letter from Duane M. Byers of Nixon & Vanderhye P.C., dated Jul. 24, 2009, including excerpts from Surfer Magazine, Jul. 2006.
Exhibit I accompanying Letter from Duane M. Byers of Nixon & Vanderhye P.C., dated Jul. 24, 2009, including excerpts from Surfer Magazine, Jul. 1983.
Exhibit J accompanying Letter from Duane M. Byers of Nixon & Vanderhye P.C., dated Jul. 24, 2009, including excerpts from Billabong hi-summer 06 mens garments marketing materials.
Exhibit K accompanying Letter from Duane M. Byers of Nixon & Vanderhye P.C., dated Jul. 24, 2009, including excerpts from Billabong hi-summer 05 mens garments marketing materials.
Exhibit L accompanying Letter from Duane M. Byers of Nixon & Vanderhye P.C., dated Jul. 24, 2009, including excerpts from Surfer Magazine, Feb. 2007.
Exhibit M accompanying Letter from Duane M. Byers of Nixon & Vanderhye P.C., dated Jul. 24, 2009, including Xcel Wetsuits Hawaii marketing materials.
Exhibit N accompanying Letter from Duane M. Byers of Nixon & Vanderhye P.C., dated Jul. 24, 2009, including excerpts from Billabong summer '07 marketing materials.
Exhibit O accompanying Letter from Duane M. Byers of Nixon & Vanderhye P.C., dated Jul. 24, 2009, including excerpts from Billabong summer '07 marketing materials.
Exhibit P accompanying Letter from Duane M. Byers of Nixon & Vanderhye P.C., dated Jul. 24, 2009, including Xcel Hawaii, Inc. marketing materials.
Exhibit Q accompanying Letter from Duane M. Byers of Nixon & Vanderhye P.C., dated Jul. 24, 2009, including excerpts from Xcel Hawaii, Inc. marketing materials.
Chart 1 accompanying Letter from Duane M. Byers of Nixon & Vanderhye P.C., dated Jul. 24, 2009.
Chart 2 accompanying Letter from Duane M. Byers of Nixon & Vanderhye P.C., dated Jul. 24, 2009.
Communication pursuant to Rule 114(2) EPC dated Jul. 30, 2009 for application No. PCT/US2008071332, including a letter from I.J.C. M.E de Grave-Wolterink of EP&C, dated Jul. 15, 2009, regarding European Patent Application EP 08796705.5.
International Search Report and Written Opinion in PCT Application No. PCT/US2008/071332, mailed Jun. 25, 2009.
Supplementary European Search Report and the European Search Opinion for European Patent Application No. EP08796705.5, mailed on Jul. 8, 2010.
First Examination Report mailed Dec. 8, 2010 in Australian Patent Application No. 2008287170.
Office Action mailed Dec. 9, 2009 for U.S. Appl. No. 11/837,216.
Final Office Action mailed Apr. 28, 2010 for U.S. Appl. No. 11/837,216.
Notice of Allowance mailed Oct. 5, 2010 for U.S. Appl. No. 11/837,216.
Third Party Observations under Article 115 EPC, dated May 4, 2011, from European Patent Application No. 08796705.5.
Office Action mailed Dec. 18, 2009 in U.S. Appl. No. 11/837,216.
Final Office Action mailed Apr. 28, 2010 in U.S. Appl. No. 11/837,216.
Notice of Allowance mailed Oct. 5, 2010 in U.S. Appl. No. 11/837,216.
Office Action for Australian Patent Application No. 2011242133, mailed on Mar. 5, 2012.
Office Action for Japanese Patent Application No. 2010-520110, mailed on Feb. 29, 2012.

* cited by examiner

WATER SHORTS INCORPORATING A STRETCH TEXTILE

CROSS-REFERENCE TO RELATED APPLICATION

This application is a continuation of and claims priority to U.S. patent application Ser. No. 11/837,216, which was filed in the U.S. Patent and Trademark Office on 10 Aug. 2007 and entitled Water Shorts Incorporating A Stretch Textile, such prior U.S. patent application being entirely incorporated herein by reference.

BACKGROUND

Various types of swimwear are worn during aquatic activities, including swimming, diving, surfing, water skiing, and scuba diving. As an example of one type of swimwear, racing suits are commonly worn when engaging in competitive swimming or diving. Racing suits are generally formed from stretch knitted textiles (e.g., knitted textiles that incorporate spandex and stretch more than ten percent prior to tensile failure) that provides a tight-fitting configuration to reduce drag. Although some racing suits only cover the pelvic region of an individual, other racing suits cover a majority of the torso and may extend over arms and legs of the individual. As an example of a second type of swimwear, water shorts are commonly worn while surfing or engaging in recreational swimming. In contrast with the stretch knitted textiles of racing suits, water shorts are generally formed from non-stretch woven textiles (e.g., woven textiles that stretch less than ten percent prior to tensile failure) and exhibit a loose-fitting configuration. Although water shorts may be relatively tight around the waist of an individual, water shorts are generally loose-fitting in the pelvic region and the leg regions of the individual.

Stretch knitted textiles and non-stretch woven textiles react differently when immersed in water or otherwise saturated with water. More particularly, stretch knitted textiles may stretch or otherwise deform when exposed to fluid flow or subjected to the additional weight of being saturated with water. When pre-stretched to impart the tight-fitting configuration of racing suits (i.e., when a racing suit is worn), however, tension in the stretch knitted textiles is generally sufficient to overcome the deformation that occurs as a result of being saturated with water. In contrast with stretch knitted textiles, non-stretch woven textiles are dimensionally-stable. Given the loose-fitting configuration of water shorts, non-stretch woven textiles are generally utilized in order to reduce deformation that occurs when the water shorts are exposed to fluid flow or subjected to the additional weight of being saturated with water. That is, the non-stretch woven textiles utilized in water shorts remain dimensionally-stable when exposed to water.

Two common techniques for manufacturing textiles are knitting and weaving. Knitting involves the formation of a plurality of columns of intermeshed loops to form a knitted textile. Many stretch textiles are manufactured through knitting because relatively large spaces between yarns in the knitted textiles enhance stretch. For this reason, the stretch textiles utilized in racing suits are often knitted textiles. The relatively large spaces between yarns in knitted textiles also tend to hold a relatively large quantity of water, thereby increasing the deformation that occurs as a result of being saturated with water. Weaving involves intersecting yarns that cross each other at right angles to form a woven textile. Many non-stretch textiles are manufactured through weaving because the longitudinally-extending yarns and relatively small spaces between the yarns in the woven textiles provide lesser stretch than knitted textiles. For this reason, the non-stretch textiles utilized in water shorts are often woven textiles. The relatively small spaces between yarns in woven textiles also tend to hold a relatively small quantity of water, thereby decreasing the deformation (in comparison with knit textiles) that occurs as a result of being saturated with water.

Knitted textiles and woven textiles, whether of stretch or non-stretch types, also differ in terms of durability and permanent deformation. In comparison with woven textiles, knitted textiles may be less abrasion resistant and may snag more easily. When formed from similar materials, therefore, the overall durability of woven textiles may be greater than knitted textiles. In addition, knitted textiles may permanently deform more easily than woven textiles when subjected to tensile forces (i.e., when stretched). More particularly, the yarns forming loops in the knitted textiles may slide relative to each other and cause the knitted textiles to permanently remain in a stretched state, whereas woven textiles are less likely to become permanently stretched when subjected to tensile forces.

SUMMARY

Features of a pair of water shorts disclosed below relates to a first woven textile and a second woven textile. The first woven textile forms a majority of an exterior surface and an opposite interior surface of the water shorts, and the first woven textile exhibits at least thirty percent stretch prior to tensile failure. The second woven textile is located around a waistband portion of the water shorts, for example, and the second woven textile exhibits less than ten percent stretch prior to tensile failure.

The advantages and features of novelty characterizing aspects of the invention are pointed out with particularity in the appended claims. To gain an improved understanding of the advantages and features of novelty, however, reference may be made to the following descriptive matter and accompanying drawings that describe and illustrate various embodiments and concepts related to the invention.

FIGURE DESCRIPTIONS

The foregoing Summary of the Invention and the following Detailed Description of the Invention will be better understood when read in conjunction with the accompanying drawings.

DETAILED DESCRIPTION

The following discussion and accompanying figures disclose an article of apparel 10 having a configuration of a pair of water shorts. Although the structure of apparel 10 and the materials incorporated into apparel 10 are suitable for use during a variety of aquatic activities (e.g., swimming, diving, surfing, water skiing, and scuba diving), apparel 10 may also be worn while engaging in land-based activities. Accordingly, apparel 10 may be suitable for a variety of aquatic and non-aquatic activities.

Figure 1:
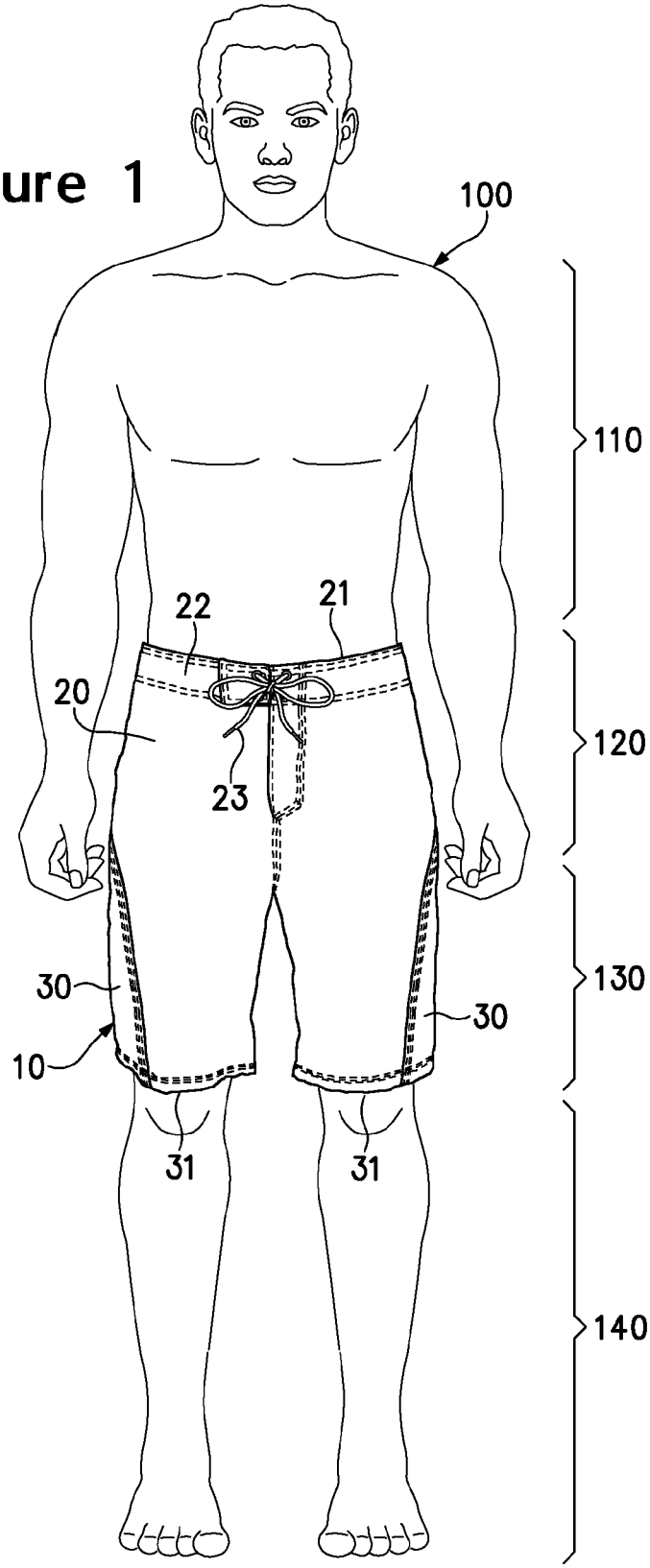
FIG. 1 is a front elevational view of an individual wearing an article of apparel.
Figure 2:
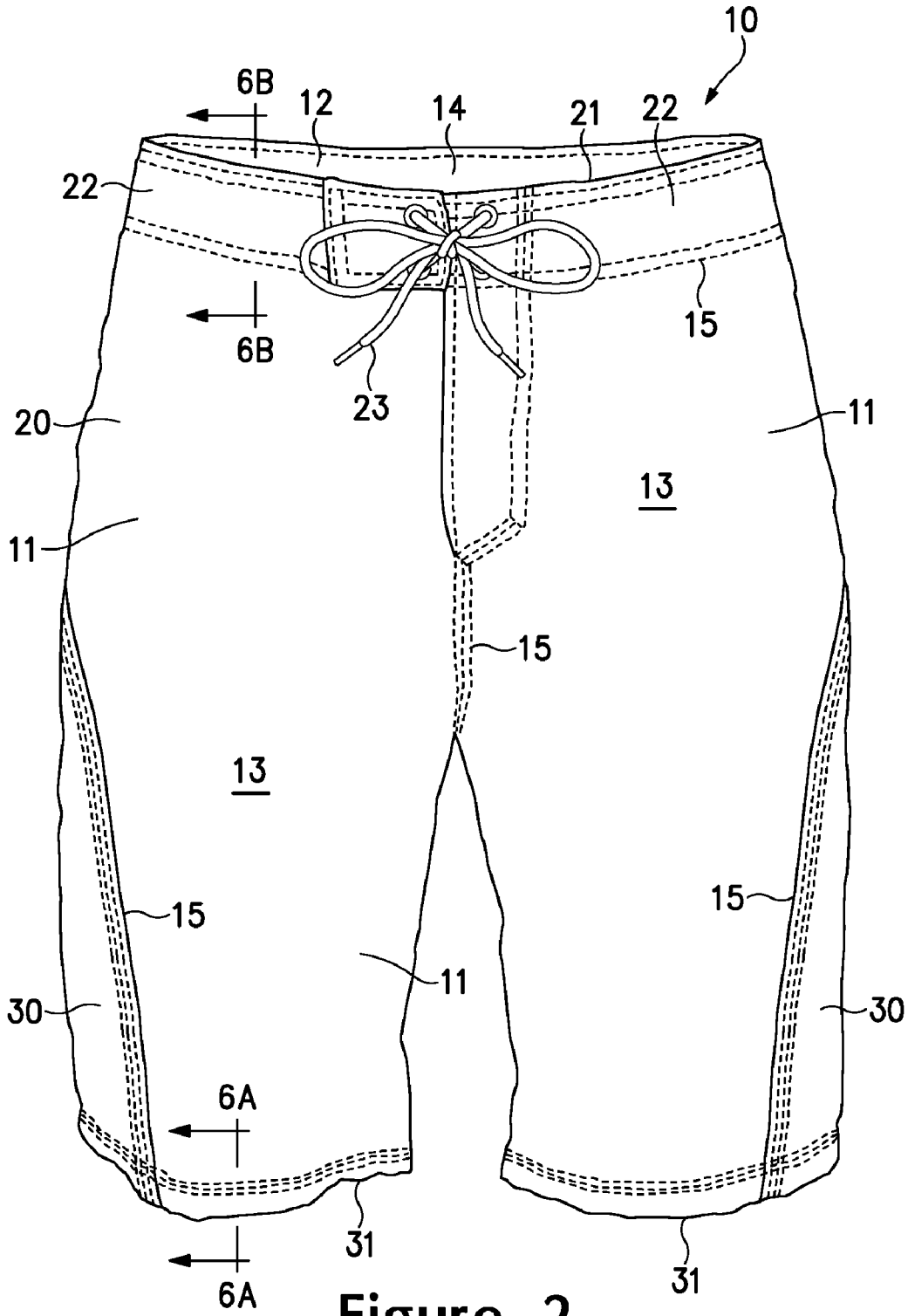
FIG. 2 is a front elevational view of the article of apparel.
Figure 3:
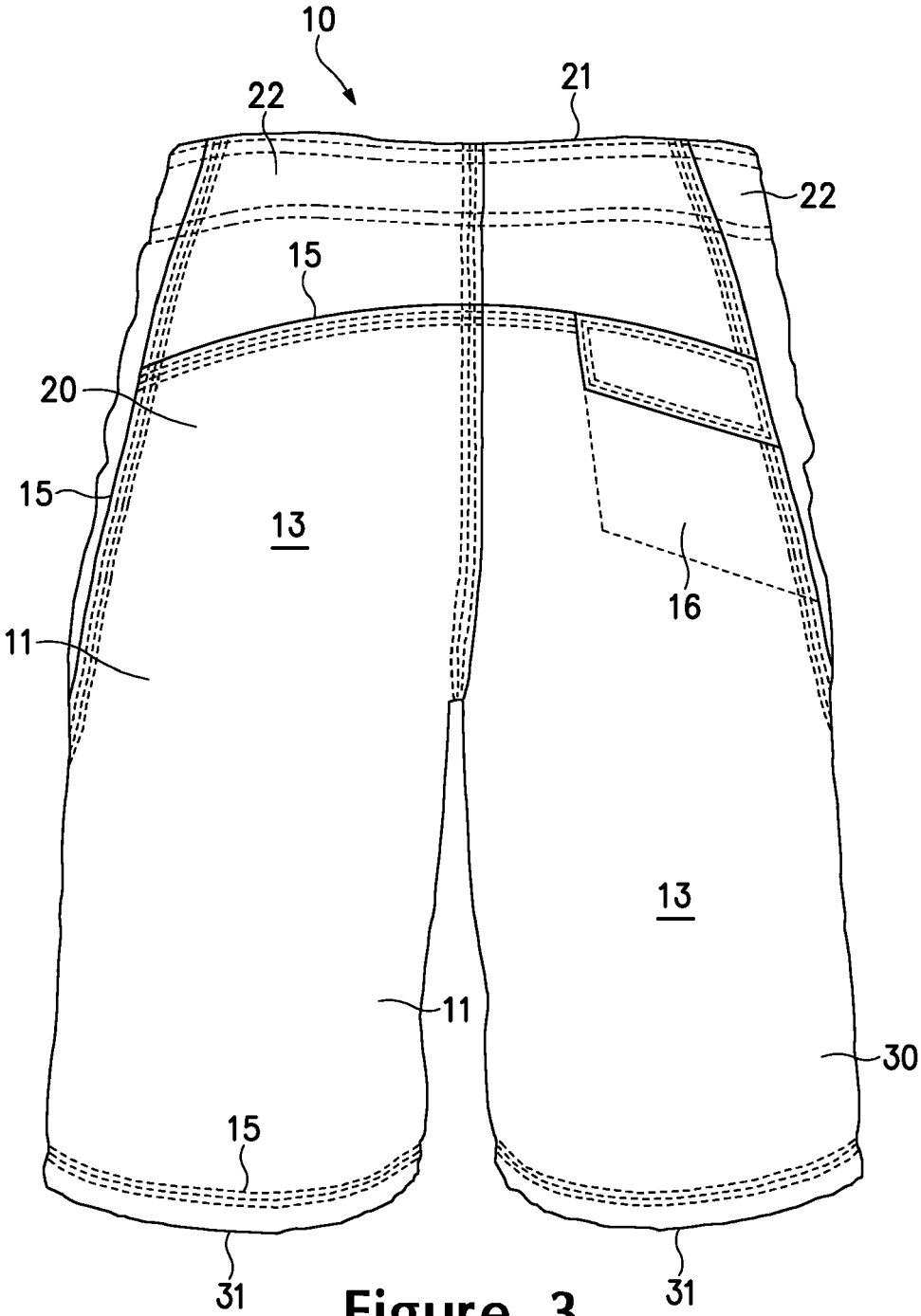
FIG. 3 is a rear elevational view of the article of apparel.
Figure 4:
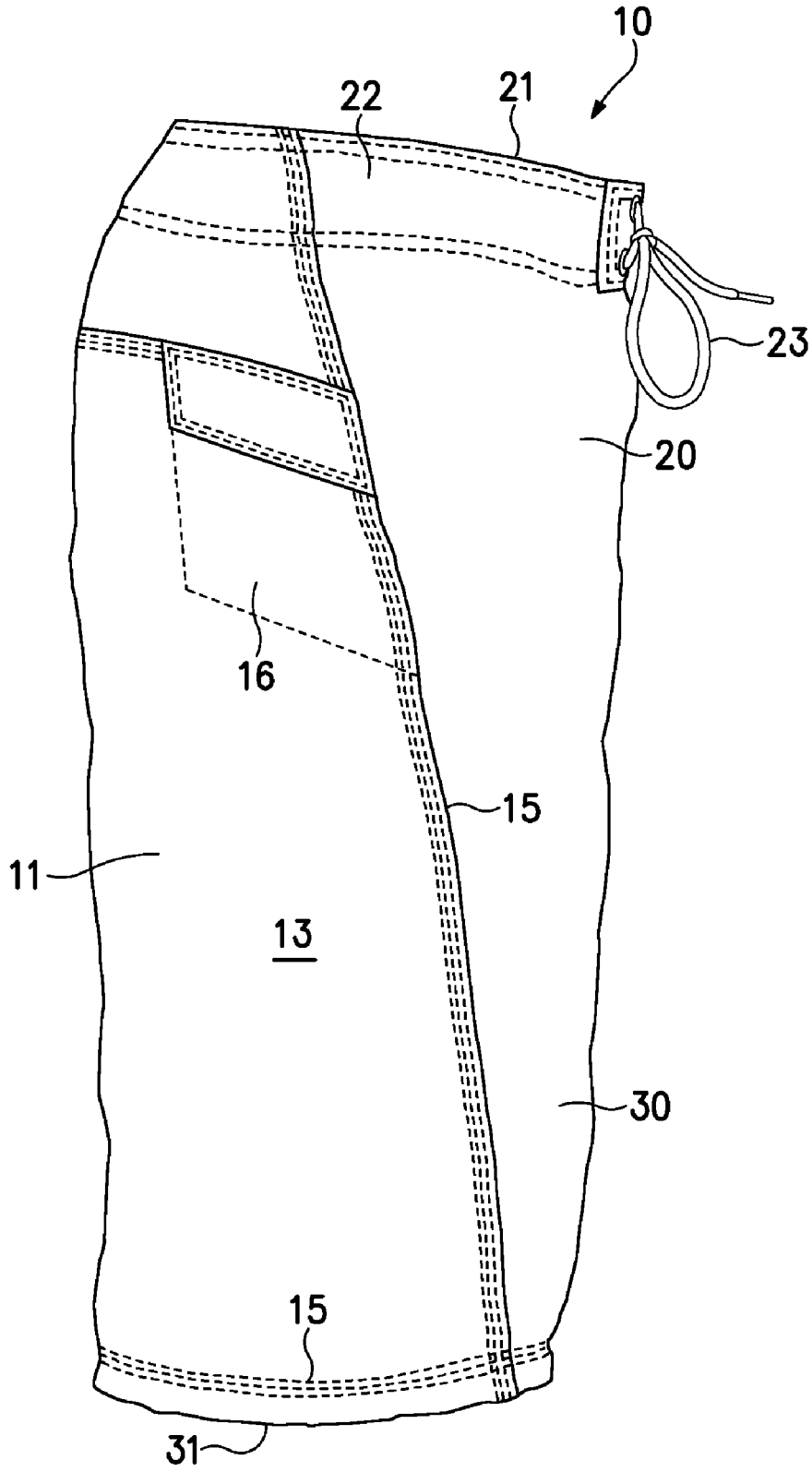
FIG. 4 is a first side elevational view of the article of apparel.
Figure 5:
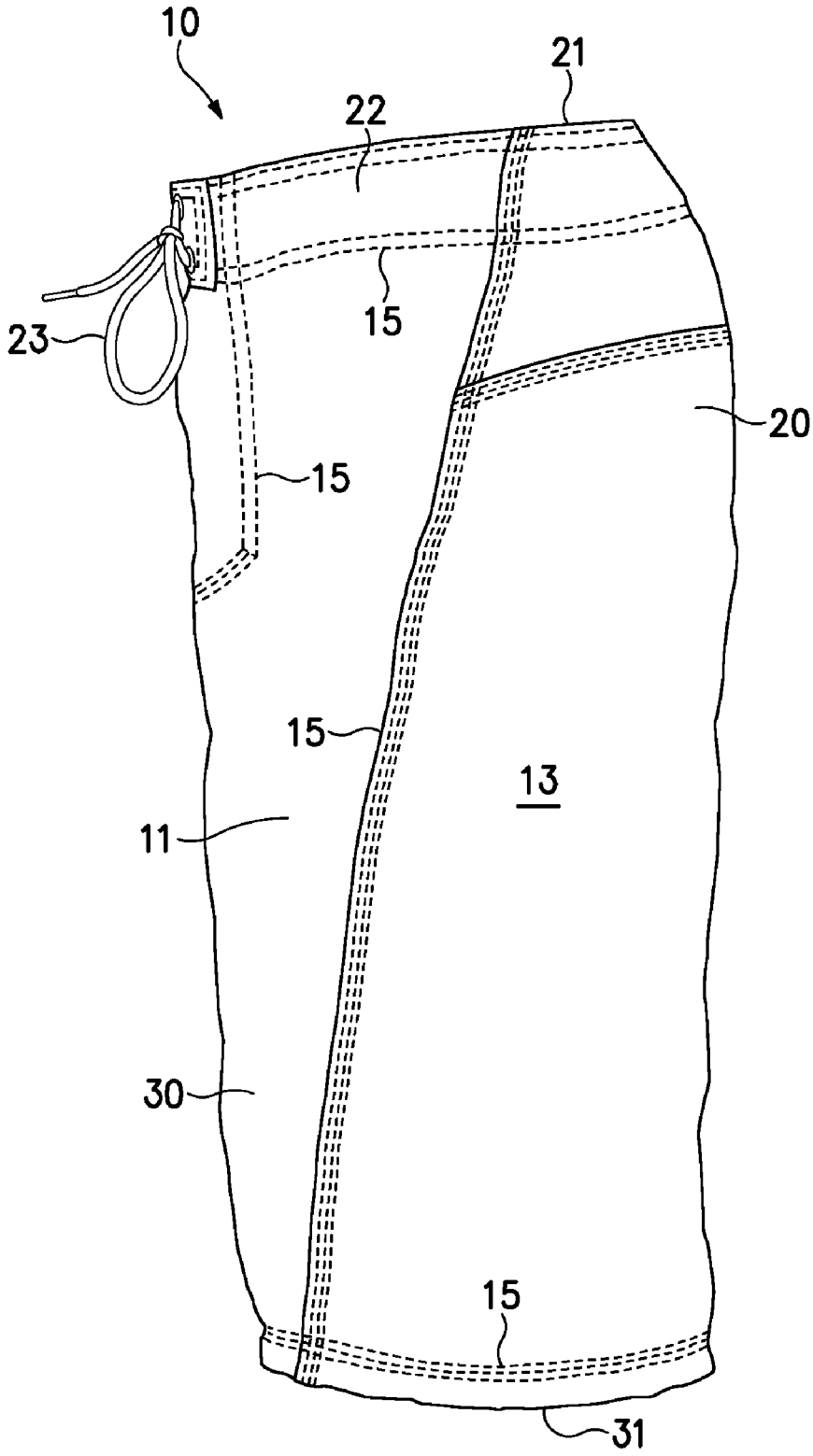
FIG. 5 is a second side elevational view of the article of apparel.

With reference to FIG. 1, apparel 10 is depicted as being worn by an individual 100 with a torso region 110, a pelvic region 120, a pair of upper leg regions 130, and a pair of lower leg regions 140. In addition, various views of apparel 10 in the absence of individual 100 are provided in FIGS. 2-5. A pelvic area 20 of apparel 10 substantially extends around and covers pelvic region 120 of individual 100, and a pair of leg areas 30 of apparel 10 substantially extend around and cover upper leg regions 130 of individual 100. Areas 20 and 30 are not intended to demarcate precise areas of apparel 10. Rather, areas 20 and 30 are intended to represent general areas of apparel 10 that provide a frame of reference during the following discussion. Pelvic area 20 defines an upper opening 21 in apparel 10 out of which torso region 110 extends. Similarly, each of leg areas 30 define a pair of lower openings 31 out of which lower leg regions 140 extend.

Pelvic area 20 includes a waistband 22 that extends around apparel 10 adjacent to upper opening 21. A lace 23 extends through various apertures in a front area of waistband 22, and lace 23 crosses between the apertures. Although a fly portion of pelvic area 20, which includes lace 23 and a portion of waistband 22, may have a variety of configurations, the fly portion is depicted as having a configuration disclosed in U.S. Pat. No. 6,199,215 to Biggerstaff. When apparel 10 is worn by individual 100, lace 23 may be utilized in a conventional manner to adjust the circumference of waistband 22. That is, lace 23 may be tensioned and tied to secure apparel 10 to individual 100, and lace 23 may be untied and loosened to assist in removing apparel 10 from individual 100. Although lace 23 is depicted as extending through the apertures in waistband 22, lace 23 may alternately extend around the circumference of waistband 22. That is, lace 23 may extend through a channel formed in waistband 22 so as to extend entirely around pelvic region 120 of individual 100. Lace 23 may also be absent such that a zipper, snap, button, or hook and loop fastener, for example, is utilized.

With the exception of waistband 22, a majority of apparel 10 has a loose-fitting configuration. That is, apparel 10 is generally structured to be spaced from individual 100 or in loose contact with individual 100 when worn, rather than in tight-fitting contact with individual 100. As discussed in the Background section above, many pairs of water shorts are primarily formed from non-stretch woven textiles. In contrast, apparel 10 may be primarily formed from a stretch woven textile 11. That is, a relatively large portion of the woven textiles utilized in apparel 10 are stretch woven textiles.

Figure 6A:
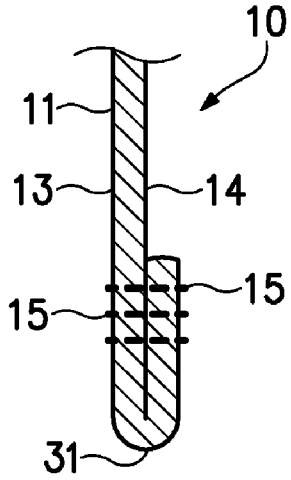
FIGS. 6A and 6B are cross-sectional views of the article of apparel, as defined in FIG. 2.

Stretch woven textile 11 forms both an exterior surface 13 and an opposite interior surface 14 of apparel 10 in a majority of apparel 10. Referring to FIG. 6A, a cross-section through a portion of apparel 10 is depicted. As shown in the cross-section, stretch woven textile 11 forms both exterior surface 13 and interior surface 14. Although the cross-section is shown through one of leg areas 30, stretch woven textile 11 also forms both exterior surface 13 and interior surface 14 in a majority of pelvic area 20. In some configurations of apparel 10, various appliqués, transfers, patches, indicia, tags, pulls, or other aesthetic or functional features of apparel 10 may also form a portion of either of surfaces 13 and 14. A majority of exterior surface 13 and interior surface 14, however, is formed from stretch woven textile 11.

Figure 6B:
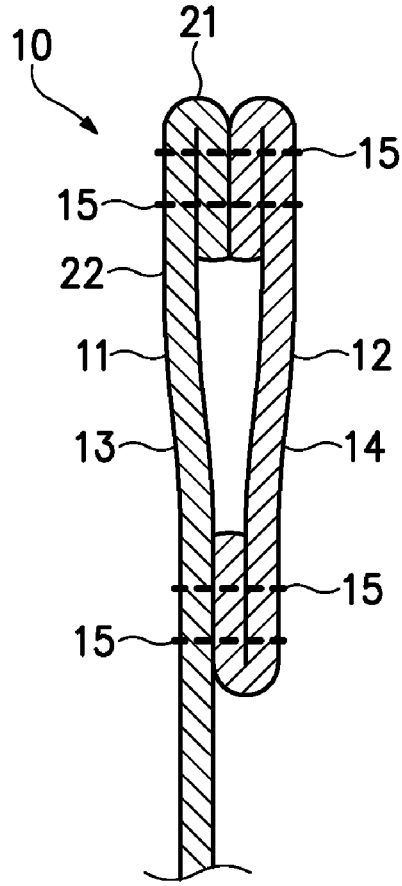

One area where stretch woven textile 11 may not form both of surfaces 13 and 14 is in waistband 22. Referring to FIG. 6B, a cross-section through a portion of waistband 22 is depicted. As shown in the cross-section, stretch woven textile 11 forms exterior surface 13, but a non-stretch woven textile 12 forms interior surface 14. That is, waistband 22 has a layered configuration wherein stretch woven textile 11 forms an exterior layer that defines exterior surface 13 and non-stretch woven textile 12 forms an interior layer that defines interior surface 14. Whereas stretch woven textile 11 has a stretch configuration, non-stretch woven textile 12 has a substantially non-stretch configuration. As noted above, a majority of apparel 10 has a loose-fitting configuration, with the exception of waistband 22, which is tightened to secure apparel 10 to individual 100. By forming a portion of waistband 22 from non-stretch woven textile 12, tensioning lace 23 may effectively induce tension in waistband 22 and assist with securing apparel to individual 100. Although non-stretch woven textile 12 extends around substantially all of waistband 22, non-stretch woven textile 12 may extend around only a portion of waistband 22 in some configurations of apparel 10. That is, non-stretch woven textile 12 may be limited to side and rear portions of waistband 22, or non-stretch woven textile 12 may be absent from the side areas, for example.

Figure 7A:
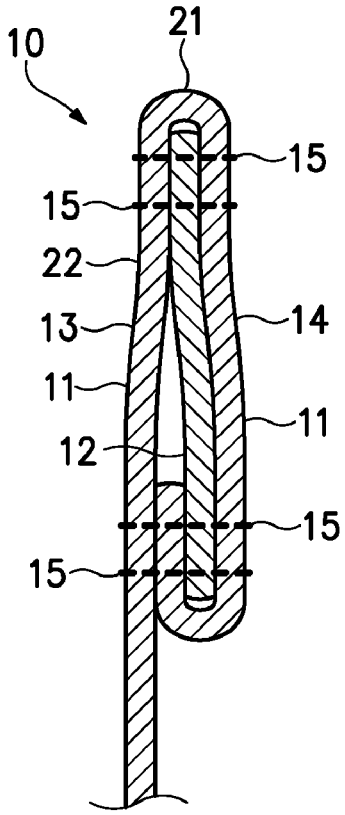
FIGS. 7A and 7B are cross-sectional views corresponding with FIG. 6B and depicting further configurations of the article of apparel.
Figure 7B:
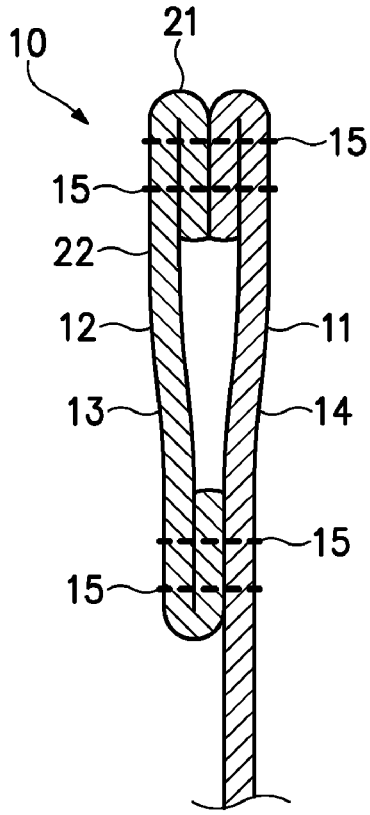
Figure 8:
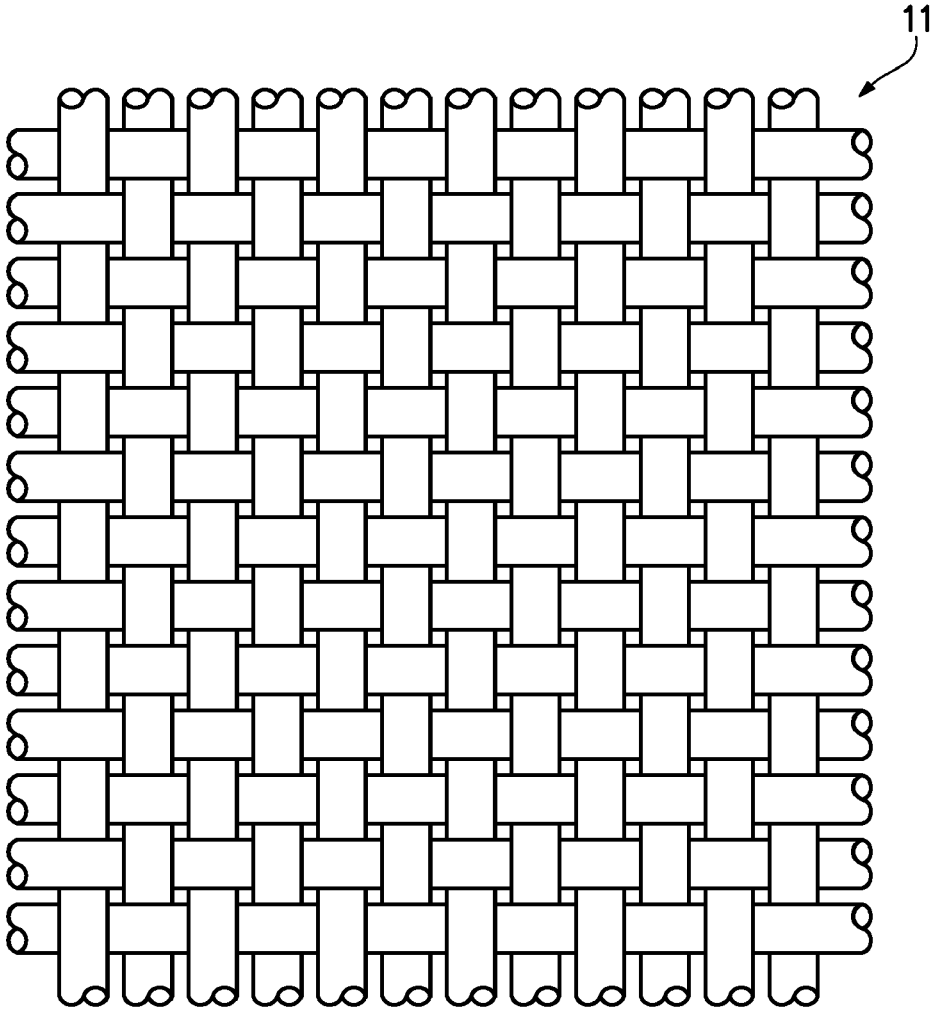
FIG. 8 is a plan view of a portion of a woven textile that may be incorporated into the article of apparel.

The locations of woven textiles 11 and 12 depicted in FIG. 6B provide an example of a suitable configuration for waistband 22. In another configuration, which is depicted in FIG. 7A, non-stretch woven textile 12 is located within stretch woven textile 11. That is, stretch woven textile 11 wraps around non-stretch woven textile 12 to locate non-stretch woven textile 12 in an interior portion of waistband 22. As another example of a configuration of waistband 22, non-stretch woven textile 12 may be located on the exterior of apparel 10, thereby forming a portion of exterior surface 13, as depicted in FIG. 7B.

Yarns within stretch woven textile 11 may be at least partially formed from any of polyamide, polyester, nylon, spandex, wool, silk, or cotton materials, for example. More particularly, the yarns may be eighty percent polyamide and twenty percent spandex in some configurations. When formed from a combination of polyamide and spandex, for example, stretch woven textile 11 may exhibit at least thirty percent stretch prior to tensile failure, but may also exhibit at least fifty percent or at least eighty percent stretch prior to tensile failure. In some configurations of apparel 10, the stretch in stretch woven textile 11 may equal or exceed one-hundred-twelve percent. An advantage of the stretch properties of stretch woven textile 11 relates to comfort. More particularly, stretch woven textile 11 will stretch to conform with movements of individual 100 during aquatic or land-based activities, thereby providing less restriction and a greater freedom of movement during the activities.

In comparison with some knit textiles, stretch woven textile 11 may have a relatively dense structure. That is, the spaces between adjacent yarns may be relatively small in stretch woven textile 11. An advantage of this configuration is that stretch woven textile 11 may be relatively thin and lightweight. Another advantage is that the relatively small spaces between the yarns in stretch woven textile 11 tend to hold a relatively small quantity of water and exhibit relatively little deformation as a result of being saturated with water. While prior pairs of water shorts were formed from a non-stretch woven textile to limit excess weight and deformation when saturated with water, apparel 10 may overcome these issues while being formed from stretch woven textile 11. That is, despite being a stretch textile, stretch woven textile 11 is suitable for apparel 10 having the configuration of a pair of water shorts. In addition, a further advantage of utilizing stretch woven textile 11 relates to relatively high durability and a relatively low tendency to permanently deform when subjected to tensile forces (i.e., when stretched).

Yarns within non-stretch woven textile 12 may be at least partially formed from any of polyamide, polyester, nylon, spandex, wool, silk, or cotton materials, for example. Depending upon the materials selected for the yarns, non-stretch woven textile 12 may exhibit less than ten percent stretch prior to tensile failure, but may also exhibit less than five percent stretch or less than three percent stretch prior to tensile failure. Accordingly, the structure, materials, and properties of non-stretch woven textile 12 may vary significantly.

As discussed in the Background section above, many pairs of conventional water shorts are primarily formed from non-stretch woven textiles. That is, the pelvic area (including the waistband) and the leg areas of conventional water shorts are formed from non-stretch woven textiles. Each area of conventional water shorts, therefore, are primarily formed from materials that are substantially non-stretch. In contrast, apparel 10 utilizes woven textiles with different stretch properties in different areas. More particularly, a portion of waistband 22 is formed from non-stretch woven textile 12, whereas other portions of pelvic area 20 and leg areas 30 is formed from stretch woven textile 11. Accordingly, the stretch properties of the woven textiles forming apparel 10 vary in different areas of apparel 10.

A plurality of different elements of each of stretch woven textile 11 and non-stretch woven textile 12 may be joined to form apparel 10. That is, apparel 10 may have various seams 15 that are stitched or glued, for example, to join the various elements of stretch woven textile 11 and non-stretch woven textile 12 together. As depicted in both of FIGS. 6A and 6B, edges of the various elements of stretch woven textile 11 and non-stretch woven textile 12 may be folded inward and secured with additional seams 15 to limit fraying and impart a finished aspect to apparel 10. In addition, further elements of either of stretch woven textile 11 and non-stretch woven textile 12 may be utilized to form a pocket 16 within apparel 10 or impart adjustability to the fly area of apparel 10.

Many prior pairs of water shorts were manufactured through a traditional construction method that utilized a size 604 polyester thread to form felled seam stitches at nine stitches per inch. In apparel 10, however, a size 502 nylon thread may be utilized to form triple coverstitch seams at seven to eight stitches per inch. Accordingly, the construction method (i.e., thread size and stitch configuration) for apparel 10 may vary from the traditional construction method utilized in many prior pairs of water shorts.

The configuration of apparel 10 depicted in FIGS. 1-6B provides an example of a suitable structure for a pair of water shorts. In another configuration, portions of leg areas 30 or other portions of pelvic areas 20 may be partially formed from non-stretch woven textile 12. For example, strips of non-stretch woven textile 12 may extend along side areas of apparel 10 to limit stretch in these areas. As another example, non-stretch woven textile 12 may be located adjacent to lower openings 31 to limit stretch in these areas. In yet another configuration, the length of leg areas may be increased or decreased to cover different areas of leg regions 130 and 140. Accordingly, apparel 10 may incorporate a variety of structural changes that depart from the specific configuration depicted in the figures.

The invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

The invention claimed is:

1. An article of apparel comprising:

a pelvic region for covering a pelvic area of a wearer, the pelvic region defining a waistband for extending around a waist of the wearer, the waistband having a first layer and a second layer that lay adjacent to each other and are secured to each other, the first layer being formed from a first textile with a woven configuration that exhibits more than fifty percent stretch prior to tensile failure, and the second layer being formed from a second textile that exhibits less stretch than the first textile; and a pair of leg regions extending outward from the pelvic region for covering at least a portion of legs of the wearer, the article of apparel having an exterior surface and an opposite interior surface, a majority of the exterior surface and the interior surface being formed from the first textile.

2. The article of apparel recited in claim 1, wherein the first layer and the second layer are secured to each other with stitching in the waistband.

3. The article of apparel recited in claim 1, wherein the first textile is at least partially formed from polyamide and spandex materials.

4. The article of apparel recited in claim 1, wherein the first textile exhibits more than sixty percent stretch prior to tensile failure.

5. The article of apparel recited in claim 1, wherein the first textile includes seams that join elements of the first textile together.

6. The article of apparel recited in claim 1, further including (a) a plurality of apertures extending through the waistband and (b) a lace extending through the apertures.

7. The article of apparel recited in claim 6, wherein the apertures extend through the first layer and the second layer.

8. An article of apparel comprising:

a pelvic region for covering a pelvic area of a wearer, the pelvic region defining a waistband for extending around a waist of the wearer, the waistband having a layered structure that includes a first material and a second material, the first material being a woven textile that exhibits more than fifty percent stretch prior to tensile failure, and the second material exhibiting less stretch than the first material, the first material being secured to the second material in the waistband, and a majority of an exterior surface and an interior surface of the apparel in the pelvic region being formed from the first material; and a pair of leg regions for covering at least a portion of legs of the wearer, a majority of the exterior surface and the interior surface of the apparel in the leg regions being formed from the first material.

9. The article of apparel recited in claim 8, wherein the first material and the second material are secured to each other with stitching in the waistband.

10. The article of apparel recited in claim 8, wherein the first material is at least partially formed from polyamide and spandex materials.

11. The article of apparel recited in claim 8, wherein the first material exhibits more than sixty percent stretch prior to tensile failure.

12. The article of apparel recited in claim 8, wherein the first material includes seams that join elements of the first material together.

13. The article of apparel recited in claim 8, further including (a) a plurality of apertures extending through the waistband and (b) a lace extending through the apertures.

14. An article of apparel having a pelvic region and a pair of leg regions extending outward from the pelvic region, the apparel comprising:

a first material having a woven textile configuration and exhibiting more than fifty percent stretch prior to tensile failure, the first material forming a first layer of a waistband in the pelvic region; and a second material exhibiting less stretch than the first material, the second material forming a second layer of the waistband, the first layer and the second layer laying adjacent to each other and being secured to each other in the waistband.

15. The article of apparel recited in claim 14, wherein the first material and the second material are secured to each other with stitching in the waistband.

16. The article of apparel recited in claim 14, wherein the first material is at least partially formed from polyamide and spandex materials.

17. The article of apparel recited in claim 14, wherein the first material exhibits more than sixty percent stretch prior to tensile failure.

18. The article of apparel recited in claim 14, wherein the first material includes seams that join elements of the first material together.

19. The article of apparel recited in claim 14, wherein the first layer forms a portion of the exterior surface and the second layer forms a portion of the interior surface.

20. The article of apparel recited in claim 14, further including (a) a plurality of apertures extending through the waistband and (b) a lace extending through the apertures.

21. An article of apparel comprising:

a pelvic region for covering a pelvic area of a wearer, a majority of an exterior surface and an interior surface of the apparel in the pelvic region being formed from a first material with a woven configuration that exhibits more than fifty percent stretch prior to tensile failure, the pelvic region including a waistband for extending around a waist of the wearer, the waistband including a second material exhibiting less stretch than the first material, the first material being secured to the second material in the waistband; and a pair of leg regions for covering at least a portion of legs of the wearer, a majority of the exterior surface and the interior surface of the apparel in the leg regions being formed from the first material.

22. The article of apparel recited in claim 21, wherein the first material exhibits more than sixty percent stretch prior to tensile failure.

23. The article of apparel recited in claim 21, wherein the first material includes seams that join elements of the first material together.

24. The article of apparel recited in claim 21, further including (a) a plurality of apertures extending through the waistband and (b) a lace extending through the apertures.

* * * * *